United States Patent [19]

Block

[11] 3,971,695

[45] July 27, 1976

[54] METHOD AND APPARATUS FOR THE PRODUCTION OF FILTER PLUGS

[75] Inventor: Hans-Jürgen Block, Hamburg, Germany

[73] Assignee: Hauni-Werke Korber & Co., KG, Hamburg, Germany

[22] Filed: Jan. 19, 1970

[21] Appl. No.: 4,018

[52] U.S. Cl. ..... 156/461; 93/1 C; 156/187; 156/229; 156/495; 156/543; 425/831

[51] Int. Cl.[2] ..... B31F 1/00

[58] Field of Search ..... 156/180, 187, 466, 461, 156/468, 152, 200; 370–372, 229, 378, 441, 495, 543; 93/1 C; 73/45.2, 45.1, 38; 425/83

[56] References Cited

UNITED STATES PATENTS

| | | | |
|---|---|---|---|
| 2,757,495 | 8/1956 | Reichel | 156/229 |
| 3,164,069 | 1/1965 | Wilkie et al. | 156/200 |
| 3,230,125 | 1/1966 | Hicks | 156/229 |
| 3,395,570 | 8/1968 | Kochalski | 73/38 |
| 3,399,606 | 9/1968 | Molins | 93/1 C |

FOREIGN PATENTS OR APPLICATIONS

| | | |
|---|---|---|
| 1,083,111 | 9/1967 | United Kingdom |

*Primary Examiner*—Samuel W. Engle
*Assistant Examiner*—Harold Tudor
*Attorney, Agent, or Firm*—Peter K. Kontler; John Kurucz

[57] ABSTRACT

Apparatus for making filter plugs wherein the extent to which the tow is stretched or the rate of transport of a uniformly stretched tow to the wrapping mechanism is controlled by a testing unit which determines the resistance of filter plugs to axial flow of air therethrough. Alternatively, the speed of the garniture belt in the wrapping mechanism is regulated as a function of changes in resistance to flow of testing air transversely across successive increments of a uniformly stretched tow.

19 Claims, 5 Drawing Figures

INVENTOR
BY
ATTORNEY

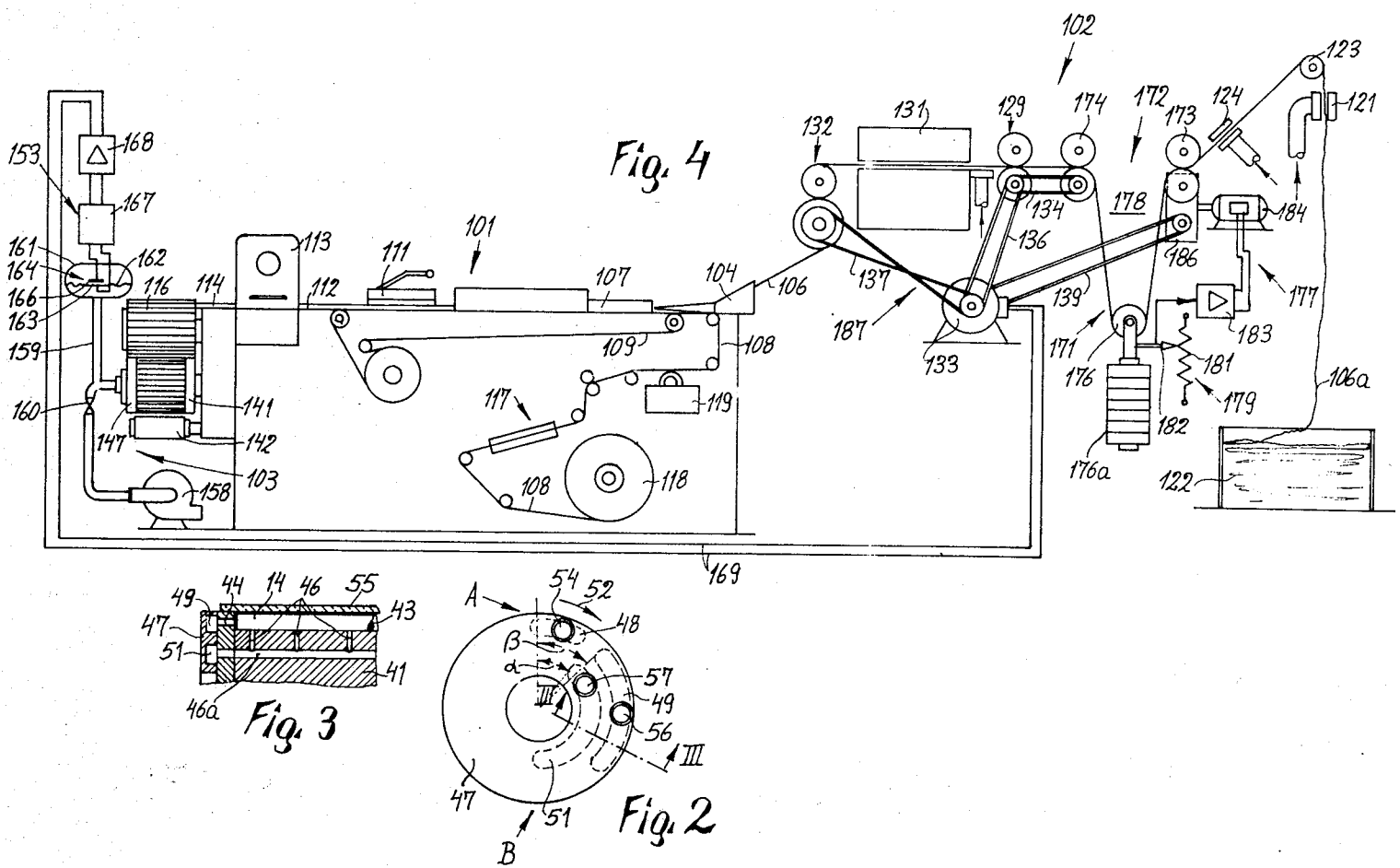
INVENTOR
BY
ATTORNEY

INVENTOR

BY

ATTORNEY

METHOD AND APPARATUS FOR THE PRODUCTION OF FILTER PLUGS

BACKGROUND OF THE INVENTION

The present invention relates to a method and apparatus for the production of filter plugs which can be used in the manufacture of filter cigarettes, filter cigars and like smokers' products.

Filter plugs are normally obtained by subdividing a wrapped filter rod whose filler consists of a tow of filamentary filter material. The tow is treated with a plasticizer and is stretched to enhance the uniformity of resistance which the filter plugs offer to the passage of smoke.

U.S. Pat. No. 3,399,606 discloses an apparatus which measures the mass of filler material in the wrapped filter rod and the resistance to air flow across the tow upstream of the wrapping station. The stretching of the tow is regulated in dependency on the results of such measurements. A drawback of the patented apparatus is that the resistance which the tow offers to radial flow of air is not necessarily indicative of resistance which a filter plug offers to axial flow of the smoke. Another drawback of the patented apparatus is that the filaments of the tow are stretched below their elastic limit. As a rule, the degree of crimping of filaments varies unpredictably in longitudinal direction of the tow and a high degree of uniformity in the mass per unit length of the tow can be achieved only if the filaments are stretched until the crimp disappears. The operation of the patented apparatus is based on the premise that the stretching action results in partial elimination of crimp because, otherwise, the filaments would be extended beyond their elastic limit and the tow would break.

SUMMARY OF THE INVENTION

An object of the invention is to provide a method of producing filter plugs whose resistance to axial flow of tobacco smoke is more uniform than in presently known filter plugs.

Another object of the invention is to provide a method of producing filter plugs wherein the mass of filter material in the filler is more homogeneous than in filter plugs which are produced in accordance with conventional methods.

A further object of the invention is to provide a novel method of controlling the stretching and/or feeding of a tow of filamentary filter material toward and through the wrapping mechanism.

An additional object of the invention is to provide an apparatus which can be utilized to carry out the improved method and to provide such apparatus with novel stretching, advancing and testing means for the tow of filamentary filter material.

Still another object of the invention is to provide novel means for testing the resistance of filter plugs to axial flow of a gaseous fluid through their fillers.

One feature of the invention resides in the provision of a method of producing filter plugs which comprises conveying a continuous tow of filamentary filter material lengthwise, subjecting the tow to a variable stretching action to thereby change the mass of filamentary material per unit length of the tow, applying a web of wrapping material around the thus stretched tow to form a wrapped filter rod, subdividing the rod into filter plugs, conveying a gaseous testing fluid axially through the filter plugs, measuring the resistance which the filter plugs offer to the flow of such fluid, and regulating the stretching action as a function of deviations of measured resistance from a predetermined value which is indicative of satifactory resistance. The filter plugs are preferably transported sideways during testing and the measuring step preferably comprises determining the average resistance of several filter plugs; the regulating step then comprises varying the stretching action as a function of deviations of the average resistance from the predetermined value.

Another feature of the invention resides in the provision of a method of producing filter plugs which comprises conveying a tow of filamentary filter material lengthwise, subjecting the tow to an at least substantially constant stretching action to thereby extend the filamentary material substantially to its elastic limit (so that the crimps disappear), applying a web of wrapping material about the thus stretched tow to form a wrapped filter rod, and thereupon subdividing the wrapped rod into filter plugs of desired length. The step of subjecting the tow to stretching action preferably comprises looping a length of the tow and subjecting the looped length to tensional stresses acting in the longitudinal direction of filamentary material; this can be achieved by suspending on the looped portion of the travelling tow a ballast whose weight suffices to insure elimination of crimps in the filaments.

The just described second method preferably further comprises the steps of conveying a gaseous testing fluid through successive portions of the stretched tow, measuring the resistance which such portions of the tow offer to the flow of testing fluid, and regulating the quantity of filter material in the wrapped rod as a function of deviations of measured resistance from a predetermined value. The testing fluid can be conveyed radially across successive increments of the stretched tow upstream of the wrapping station or axially through the fillers of filter plugs (such fillers also constitute portions of the stretched tow). The mass of filter material in the wrapped rod can be regulated by conveying the web and the stretched tow at a constant speed through the wrapping station and feeding the stretched tow toward the wrapping station at a rate which varies as a function of the results of measurements, or by feeding the stretched tow at a constant rate toward the wrapping station and coveying the tow and the web through the wrapping station at a speed which varies as a function of the results of measurements.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is an enlarged fragmentary sectional view as seen in the direction of arrows from the line II—II of FIG. 1;

FIG. 3 is a fragmentary sectional view as seen in the direction of arrows from the line III—III of FIG. 2;

FIG. 4 is a diagrammatic side elevational view of a second apparatus; and

DESCRIPTION OF THE PREFERRED EMBODIMENTS

Figure 1:
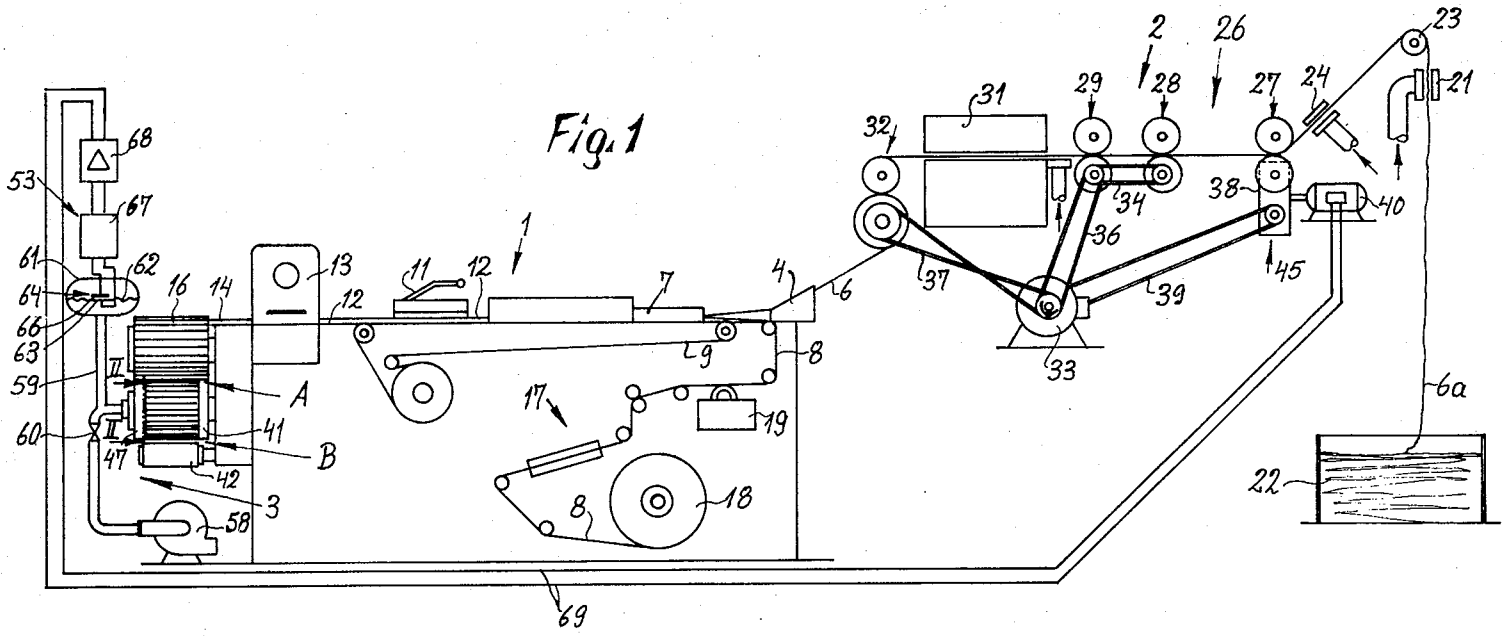
FIG. 1 is a diagrammatic side elevational view of an apparatus which embodies one form of the invention.

Referring to FIG. 1, there is shown an apparatus for the production of filter plugs 14. The apparatus comprises a plug making machine 1, a filter tow processing machine 2 and a pneumatic testing unit 3 for filter plugs 14. The filter plug machine 1 is of the type known as KDF and produced by Hauni-Werke Korber & Co., K.G., Hamburg-Bergedorf, Germany. This machine comprises the following components:

A bonded layer or tow 6 of fibers is introduced into a gathering funnel 4 which converts the layer into a cylindrical filler and feeds the filler into a wrapping mechanism 7 including an endless garniture conveyor belt 9. The mechanism 7 applies around the cylindrical filler a web 8 of cigarette paper or like wrapping material to produce a continuous wrapped filter rod 12 which passes along a heater or sealer 11 serving to complete the seam between the overlapping marginal portions of the wrapper. The rod 12 thereupon passes along a cutoff 13 which severs it at regular intervals to subdivide it into filter plugs 14 which are admitted into the flutes of a braking drum 16. The latter serves to change the direction of travel of filter plugs, i.e., it causes the filter plugs to move sideways and delivers them into successive flutes of a travelling testing conveyor 41 here shown as a drum which forms part of the aforementioned testing unit 3. The machine 1 further comprises an advancing mechanism 17 which draws the web 8 of wrapping material from a bobbin 18 and moves it along the applicator roller of a paster 19 which coats one side (or at least one marginal zone) of the web 8 with a suitable adhesive.

The filter tow processing machine 2 includes a first banding device 21 which preferably includes one or more nozzles for directing jets of air against the raw tow 6*a* of fibrous material to thereby insure that the individual filaments are separated from each other. The thus treated raw tow 6*a* is caused to pass over a deflecting roller 23 and thereupon past a second banding device 24. The raw tow 6*a* is drawn from a bale 22. The machine 2 further comprises a feeding and stretching device 26 including a first pair of stretching rolls 27 and a second pair of stretching rolls 28. The stretching rolls 28 are followed by a pair of spreading rolls 29 which convert the raw tow 6*a* into a layer upstream of an impregnating device 31 which applies to the fibers a suitable plasticizer of known composition. The layer which is formed by the spreading rolls 29 is located in a plane making a right angle with the plane of FIG. 1. The bonded layer 6 is thereupon caused to pass around a pair of deflecting rollers 32 and into the gathering funnel 4 of the machine 1.

The rolls 27, 28, 29 and the rollers 32 are driven by an electric motor 33 in the following way: the output shaft of the motor 33 drives endless chains 34, 36 which rotate the rolls 28, 29 at a constant speed. The rollers 32 are driven by an endless belt 37. A further endless chain 39 drives the input member of a variable-speed transmission 38 for the stretching rolls 27. The ratio of the transmission 38 is adjustable by a variable-speed electric motor 40; the transmission drives the stretching rolls 27 at a speed which is less than the speed of the rolls 28 and 29.

The pneumatic testing unit 3 comprises the aforementioned fluted testing drum 41 which receives filter plugs 14 from the braking drum 16 of the machine 1. Certain details of the testing drum 41 are shown in FIGS. 2 and 3. This drum has axially parallel peripheral flutes 43 which receive plugs 14 from the flutes of the drum 16 and deliver them onto the upper stretch of an endless conveyor belt 42. The drum 41 is further provided with axially parallel bores or channels 44 each of which communicates with one axial end of a flute 43, and with radially extending groups of bores or channels 46, each such group being in communication with one of the flutes 43 as shown in FIG. 3. A stationary valve plate 47 is adjacent to one axial end of the testing drum 41 and is provided with arcuate grooves 48 (shown only in FIG. 2) and 49, 51 (shown in FIGS. 2 and 3). The grooves 48, 49 can communicate with the axially parallel bores 44 and the groove 51 can communicate with groups of radial bores 46 by way of axially parallel passages 46a in the drum 41. The relative positions of grooves 48, 49, 51 are illustrated in FIG. 2, and the direction in which the drum 41 is driven is indicated by the arrow 52. The groove 48 begins at a first transfer station A where the flutes 43 of the drum 41 receive filter plugs 14 from the braking drum 16; such plugs remain in the respective flutes 43 while the drum completes about one-half of a revolution to leave the flutes at a second transfer station B where the plugs descend onto the belt 42. The purpose of the groove 48 is to effect proper positioning of filter plugs 14 in the axial direction of the respective flutes 43. The groove 49 serves to connect several filter plugs 14 at a time with an air flow resistance measuring transducer 53 and to insure that, during testing of a group of filter plugs, the air pressure at one axial end of each tested filter plug is different from air pressure at the other axial end. The purpose of the groove 51 is to connect a suction generating device 58 with those radial bores 46 which communicate with flutes 43 for filter plugs which are being tested. A stationary shroud 55 overlies those flutes 43 of the testing drum 41 which are located between the transfer stations A and B.

Conduits 54, 56, 57 respectively serve to connect the grooves 48, 49, 51 of the valve plate 47 with the suction generating device 58. The latter is preferably a conventional suction fan. The conduit 56 between the fan 58 and groove 49 has a branch 59 which connects it with the measuring transducer 53. A flow restrictor 60 in the conduit 56 throttles the outflow of air from the groove 49.

The transducer 53 comprises a suction chamber 61 which accommodates a diaphragm 62 provided with a preferably plate-like electrode 63 which forms part of a testing capacitor 64. The fixed electrode of the capacitor 64 is shown at 66. This capacitor is connected in an oscillator circuit 67 whose oscillation frequency varies as a function of changes in the distance between the electrodes 63 and 66, i.e., as a function of the position of electrode 63 in the suction chamber 61. Such distance, in turn, is a function of the resistance which the filter plugs 14 being tested offer to the flow of air from one axial end to the other axial end thereof. A measuring transducer which can be used in the testing unit 3 of the apparatus shown in FIG. 1 is disclosed, for example, in British Pat. No. 1,083,111 (see particularly FIGS. 2 and 3 of the patent). The patented transducer is actually designed for testing of wrapped tobacco rod sections and operates with compressed air; however, it can be readily adapted for operation with suction in a manner as described above.

The oscillator circuit 67 transmits signals to an amplifier 68 whose output is connected with the electric motor 40 by means of electrical connections 69. The motor 40 and the variable-speed transmission 38 constitute a control means 45 for regulating the elongation of filamentary filter material in the stretching device 26.

The operation:

The raw tow 6*a* is continuously withdrawn from the bale 22 and its filaments are separated from each other by the banding devices 21, 24 upstream of the stretching device 26. The tow 6*a* is extended between the stretching rolls 27, 28 because the rotational speed of the rolls 27 is less than that of the rolls 28. This reduces variations in distribution of the mass in the tow 6. The spreading rolls 29 thereupon convert the raw tow 6*a* into a layer which advances in a plane making a right angle with the plane of FIG. 1 and through the impregnating device 31 wherein the filaments are impregnated with a plasticizer. Such plasticizer is a softening agent which is preferably sprayed onto the filaments. Since the filaments are separated from each other (banding devices 21 and 24) and are thereupon spread apart by the rolls 29, the softening agent is capable of reaching all or nearly all filaments of the layer 6. The layer 6 is then fed into the gathering funnel 4 which delivers successive increments of the resulting filler to the wrapping mechanism 7. This mechanism applies the web 8 (which was coated with adhesive during travel along the paster 19) around the cylindrical filler to form the wrapped filter rod 12 whose seam is heated by the sealer 11. The cutoff 13 severs the rod 12 to produce a series of filter plugs 14 which are caused to enter successive flutes of the braking drum 16 and travel sideways toward the transfer station A where they enter successive flutes 43 of the testing drum 41. Suction in the groove 48 of the valve plate 47 causes the filter plugs 14 to move axially and to assume predetermined axial positions before they reach the front end of the groove 51 (angle alpha in FIG. 2). The groove 51 draws air from the corresponding passages 46a and bores 46 so that the filter plugs 14 are held against axial movement during testing. Each filter plug 14 which has covered an angle beta (shown in FIG. 2) with the associated flute 43 is thereupon subjected to the action of suction in the groove 49 and in the corresponding axially parallel bore 44. Depending on the resistance which the plug 14 offers to flow of air therethrough (as considered in axial direction of its filler), the pressure in the suction chamber 61 of the measuring transducer 53 rises or drops to cause a commensurate deformation of the diaphragm 62. The oscillator circuit 67 sends a corresponding signal to the amplifier 68 which causes the motor 40 to adjust the transmission 38 and to thus influence the action of the stretching device 26 whenever the average resistance of simultaneously tested plugs 14 deviates from a predetermined value. If the resistance of filter plugs 14 is less than such predetermined value, the transmission 38 begins to drive the stretching rolls 27 at a higher speed so that the mass of filamentary material in the filler of the rod 12 increases, i.e., the stretching action of the device 26 is reduced. This brings about an increase in the resistance to flow of air in the axial direction of resulting filter plugs. If the resistance to flow of air through the filter plugs 14 which are tested between the transfer stations A and B is higher than normal, the transmission 38 is caused to reduce the speed of the stretching rolls 27 so that the device 26 produces a more pronounced stretching action and the mass of filamentary filter material in the filter plugs 14 decreases. This results in the production of filter plugs whose resistance to the flow of testing air in axial direction (during travel past the groove 49 of the valve plate 47) is reduced and closely approximates or equals the desired resistance.

Since the apparatus of FIG. 1 regulates the stretching action as a result of measurements of resistance which the filter plugs 14 offer to axial flow of the testing fluid, such measurements are more reliable than the measurements of fluid flow across the tow. Thus, the measured resistance is identical with that which a smoker encounters in drawing the smoke through the filter plug of a cigarette or cigar.

Another advantage of the apparatus is that the transducer 53 measures the average resistance of several filter plugs 14 on the drum 41. This is desirable to insure that a single filter plug which exhibits a pronounced defect (e.g., an open seam in its wrapper) cannot unduly affect the action of the stretching device 26.

FIG. 4 illustrates a second apparatus wherein all such parts which are clearly analogous to the corresponding parts of the apparatus shown in FIG. 1 are denoted by similar reference characters plus 100. The testing unit 103 of FIG. 4 is identical with the aforedescribed testing unit 3.

The filter tow processing machine 102 is designed to eliminate all crimps from the filaments of the raw tow 106*a*. It comprises a filament straightening or extending device 171 which includes a guide assembly 172 for the tow 106*a*. The assembly 172 includes two pairs of rolls 173, 174 which are respectively driven by a variable speed transmission 186 and endless chains 136, 134. Furthermore, the straightening device 172 comprises a ballast including a freely rotatable roll 176 and a stack of weights 176a attached to the shaft of the roll 176. The latter is suspended on a median portion of a loop 178 which is formed by the tow 106*a* between the rolls 173, 174. The ballast exerts on the tow 106*a* a constant pull of predetermined magnitude which suffices to eliminate all crimps in the filaments between the rolls 173, 174. The length of the loop 178 can be regulated by a control device 177 which includes the aforementioned variable speed transmission 186, an electric motor 184 which can change the ratio of the transmission 186, a potentiometer 179 whose slider 182 is connected with and is movable up and down with the wheel 176 and whose fixed resistor 181 co-operates with the slider 182, and an amplifier 183 which transmits to the motor 184 signals in response to changes in position of the slider 182.

The motor 33 of FIG. 1 is replaced with a variable speed motor 133 which is adjustable in response to signals from the amplifier 168 of the testing unit 103. The motor 133 forms part of a second control unit 187 which can adjust the speed of the rolls 173, 174, 129 and feeding rollers 132 to thereby vary the quantity of filter material in successive increments of the bonded layer or tow 106 which is fed to the gathering funnel 104. The movable parts of the plug making machine 101 are driven at a constant speed.

The operation of the apparatus shown in FIG. 4 is as follows:

The rolls 173 draw the raw tow 106*a* from the bale 122 whereby the filaments are separated by the banding devices 121, 124 before they reach the space between the rolls 173, 174. The ballast including the wheel 176 eliminates all crimps in the filaments which form the loop 178. The weight of the ballast is preferably selected in such a way that the filaments are stretched to their elastic limit whereby each unit length of the loop 178 contains the same mass of filter material. The control unit 177 insures that the length of the loop 178 remains within a predetermined range. If the loop 178 is too long, the slider 182 descends whereby the potentiometer 179 causes the motor 184 to adjust the ratio of the transmission 186 in such a way that the rotational speed of the rolls 173 is reduced so that the length of the loop 178 decreases. If the loop 178 is too short, the slider 182 rises and the motor 184 changes the ratio of the transmission 186 to increase the rotational speed of the rolls 173; this results in a lengthening of the loop 178.

The rolls 129 thereupon spread the freshly elongated filaments of the tow 106*a* to form a layer which passes through the impregnating device 131 and between the feeding rollers 132 on its way toward the gathering funnel 104. The latter converts the bonded layer 106 into a cylindrical filler which is wrapped in the web 108 to form therewith a rod 112. The latter is severed by the cutoff 113 to yield a row of filter plugs 114 which are thereupon tested in the unit 103. Signals produced by the measuring transducer 153 are used to regulate the speed of the motor 133 which controls the quantity of filter material delivered to the machine 101 per unit of time. If the resistance which a filter plug 114 exhibits to axial flow of testing fluid is less than normal, the motor 133 delivers more filter material per unit of time so that the density of fillers in the filter plugs 114 increases. If the resistance of fillers in the plugs 114 is excessive, the motor 133 delivers less filter material per unit of time. Any changes in speed of the output member of the motor 133 are communicated to the rolls 129, 174, to feeding rollers 132, and to rolls 173 (by way of the transmission 186 which can be adjusted by the motor 133 or 184).

The garniture belt 109 constitutes a first conveyor which transports the filler and the web 108 at a constant speed through the wrapping station (mechanism 107). The feeding rollers 132 constitute a second conveyor which transports the bonded layer or tow 106 toward the wrapping station at a speed which varies as a function of changes in resistance of fillers in filter plugs 114 to the axial flow of testing fluid. In this way, the control unit 187 regulates the mass of filter material in the wrapped rod 112.

An important advantage of the apparatus shown in FIG. 4 is that it can produce filter plugs wherein the filter material is even more homogeneous than in the filter plugs 14. This is due to the fact that the device 171 eliminates all crimps before the bonded layer 106 reaches the gathering funnel 104, i.e., because the filaments of the raw tow 106*a* are extended to their elastic limit. Since the feeding rollers 132 form part of the processing machine 102, the filter plug making machine 101 of FIG. 4 requires no adjustment whatever, i.e., all of its moving parts can be driven at a constant speed.

Total elimination of crimps in the tow 106*a* constitutes a novel feature of my method and apparatus. It insures greater uniformity of filter material in the plugs 114. As a rule, the raw tow 106*a* coming from the bale 122 contains portions of greater density (pronounced crimp) which alternate with portions of lesser density (less pronounced crimp). Heretofore known filter plug making apparatus are incapable of eliminating such differences in density before the tow reaches the wrapping station. The difference in density of the tow 106*a* are often very pronounced. The weight of the ballast 176, 176*a* can be readily selected in such a way that the mass per unit length of the layer 106 entering the impregnating device 131 is at least nearly uniform.

Figure 5:
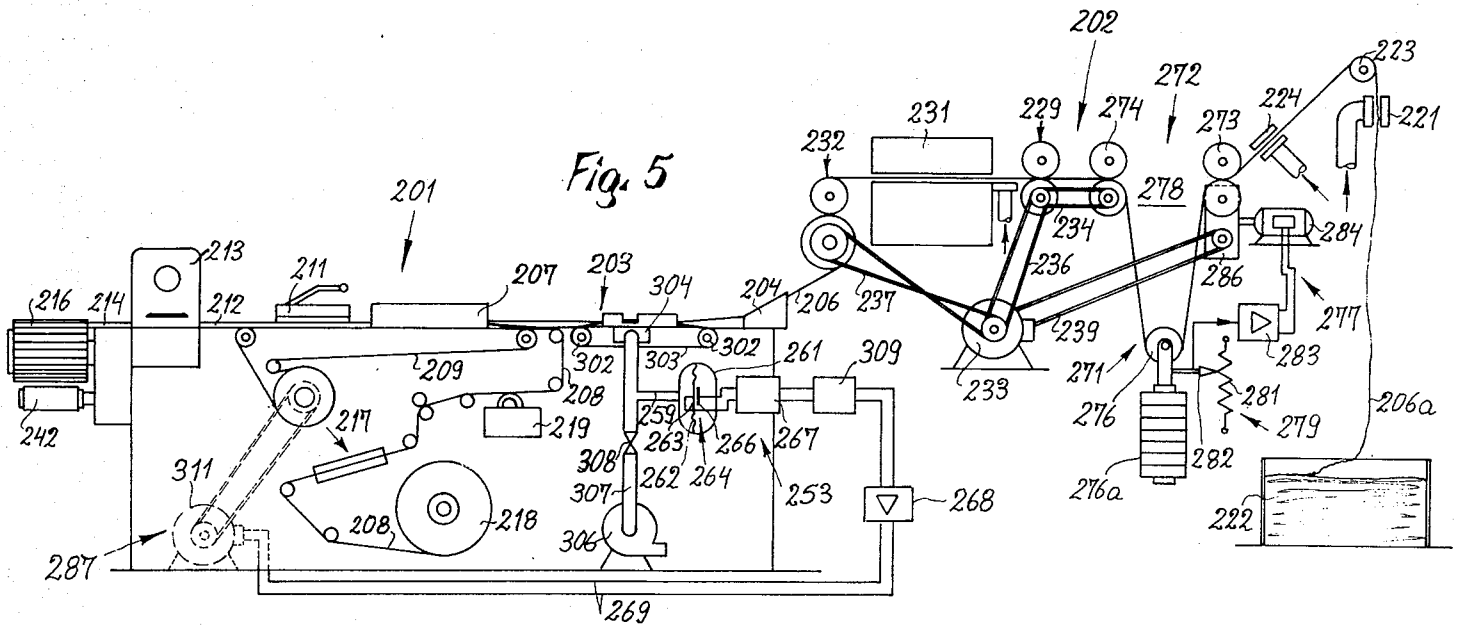
FIG. 5 is a diagrammatic side elevational view of a third apparatus.

FIG. 5 illustrates a third apparatus wherein all such parts which are analogous to corresponding parts of the apparatus of FIG. 1 are denoted by similar reference characters plus 200. An important difference between this apparatus and the apparatus of FIGS. 1 and 4 is that the testing unit 203 is designed to determine the resistance which the bonded layer 206 offers to radial flow of testing fluid, i.e., at right angles to the direction of lengthwise movement of the filaments. This testing device 203 is installed between the machines 201, 202 and tests successive increments of the bonded layer or tow 206 before the latter enters the wrapping mechanism 207. The machine 202 supplies the bonded layer 206 at a constant speed.

The testing drum 41 of FIG. 1 is replaced with a modified testing conveyor in the form of an endless belt 303 which is trained over rollers 302 and whose upper stretch is located above a suction chamber 304. The belt 303 is permeable to air and its upper stretch transports the bonded layer 206 toward the wrapping mechanism 207. The suction chamber 304 is connected with a fan 306 by means of a conduit 307 which is provided with a flow restrictor 308. The upper side of the bonded layer 206 travelling above the belt 303 is exposed to atmospheric air, i.e., there is a pressure differential between the upper and lower sides of that portion of the layer 206 which is transported by the belt 303 whereby the extent of such differential varies as a function of permeability of successive increments of the layer. The suction chamber 261 of the measuring transducer 253 is connected with the conduit 307 by a conduit 259 and accommodates the diaphragm 262 as well as the electrodes 263, 266 of the capacitor 264. The capacitor 264 is connected in the oscillator circuit 267 which transmits signals to the amplifier 268 by way of an integrator circuit 309 which smoothes out short-term variations in the intensity of transmitted signals. The amplifier 268 is connected with a control unit 287 which can change the speed of moving parts in the plug making machine 201 and includes a variable speed electric motor 311 serving to drive the garniture belt 209 of the wrapping mechanism 207. If the speed of the motor 311 is changed, the speed of the belt 209 and web 208 is changed accordingly to change the mass of filter material in filter plugs 214. The amplifier 268 is preferably a thyristor amplifier, e.g., of the type produced by the West German Firm AEG under the name MINISEMI (Type 150/20). The amplifiers 68, 168 can be of similar or identical construction.

The operation:

The rolls 273 draw the raw tow 206*a* from the bale 222 and such tow is treated by the banding devices 221, 224 and elongated by the wheel 276 of the ballast so as to eliminate crimps in filaments which pass through the impregnating device 231. Each unit length of the tow 206*a* entering the device 231 can be said to contain the same mass of filter material. The control unit 279 insures that the length of the loop 278 cannot increase beyond or decrease below predetermined upper and lower limits. The motor 233 operates at a constant speed so that the gathering funnel 204 receives the bonded layer 206 at a constant rate.

The signals which are produced by the oscillator circuit 267 of the measuring transducer 253 are smoothed by the integrator circuit 309 to eliminate short-term variations and such signals are amplified at 268 prior to being transmitted to the variable speed motor 311 of the control unit 287. The intensity of such signals is a function of the resistance which the filaments of the bonded layer 206 offer during passage along the upper stretch of the foraminous belt 303. The motor 311 insures that the resistance of the filler in the wrapped rod 212 increases or decreases, depending on the results of measurements carried out by the testing unit 203. It is to be assumed that the minimum speed of the garniture belt 209 is not less than the speed at which the bonded layer 206 is furnished to the belt 303 by the feeding conveyor 232.

It is clear that the motor 311 of FIG. 5 can be regulated by the testing unit 3 of FIG. 1 or the testing unit 103 of FIG. 4, i.e., the speed of this motor can be changed in response to testing of air flow in axial or radial direction of the filler. Also, the motor 133 of FIG. 4 can be regulated by the testing unit 203 of FIG. 5.

In the apparatus of FIG. 5, the mass of filter material per unit length of the wrapped rod 212 is changed by changing the speed of the conveyor (garniture belt 209) which transports the filler and the web 208 through the wrapping station while the speed of the conveyor 232 which feeds the bonded layer 206 to the gathering funnel 204 remains constant.

It was found that the apparatus of FIG. 5 can produce filter plugs whose fillers offer a uniform resistance to the flow of smoke despite the fact that the testing unit measures the resistance which the filler issuing from the funnel 204 offers to radial (rather than axial) flow of the testing fluid. This is attributed to the fact that the straightening device 271 extends the filaments to their elastic limit.

Without further analysis, the foregoing will so fully reveal the gist of the present invention that others can, by applying current knowledge, readily adapt it for various applications without omitting features which fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims:

1. Apparatus for converting a continuous tow of filamentary filter material and a web of wrapping material into filter plugs, comprising advancing means for conveying the tow lengthwise and including stretching means for stretching the filamentary material; wrapping means for applying the web around the thus stretched tow to form a wrapped filter rod; means for subdividing the rod into filter plugs; testing means including means for conveying a gaseous fluid axially through the filter plugs and measuring means for producing signals indicating the resistance of filter plugs to the flow of such fluid; and control means responsive to said signals for adjusting said stretching means as a function of deviations of measured resistance from a predetermined value.

2. Apparatus as defined in claim 1, wherein said means for conveying the fluid through filter plugs comprises a travelling conveyor for filter plugs and means for establishing a pressure differential between the ends of filter plugs on said conveyor.

3. Apparatus as defined in claim 2, wherein said conveyor is a rotary drum having axially parallel flutes for transporting the filter plugs sideways.

4. Apparatus as defined in claim 2, wherein said measuring means comprises transducer means arranged to produce said signals in response to changes in pressure differential between the ends of filter plugs on said conveyor.

5. Apparatus as defined in claim 4, wherein said transducer means is arranged to produce signals in response to changes in pressure differential between the ends of several filter plugs on said conveyor.

6. Apparatus as defined in claim 4, wherein said means for establishing a pressure differential between the ends of filter plugs on said conveyor comprises suction generating means and conduit means connecting one end of at least one filter plug on said conveyor with said suction generating means, said transducer means comprising a suction chamber connected with said conduit means, capacitor means including an electrode movable in said chamber as a function of pressure changes in said conduit means, and an electric circuit arranged to produce said signals as a function of the position of said electrode.

7. Apparatus for converting a continuous tow of filamentary filter material and a web of wrapping material into filter plugs, comprising advancing means for conveying the tow lengthwise and including stretching means for stretching the tow with an at least substantially constant force and substantially to the elastic limit of said filamentary material; wrapping means for applying the web around the thus stretched tow to form a wrapped filter rod; and means for subdividing the rod into filter plugs.

8. Apparatus as defined in claim 7, wherein said stretching means comprises looping means for looping a length of the tow.

9. Apparatus as defined in claim 8, wherein said stretching means further comprises a ballast of predetermined weight suspended on the looped length of the tow to produce said constant force.

10. Apparatus as defined in claim 8, wherein said looping means is adjustable and further comprising control means for adjusting said looping means so as to maintain said looped length within a predetermined range.

11. Apparatus as defined in claim 7, further comprising testing means including means for conveying a gaseous fluid through the tow having its material stretched to said limit and measuring means for producing signals indicating the resistance of the tow to the flow of such fluid, and control means responsive to said signals for regulating the quantity of filamentary material in the wrapped rod.

12. Apparatus as defined in claim 11, wherein said means for conveying the fluid comprises a travelling conveyor for filter plugs and means for establishing a pressure differential between the ends of filter plugs on said conveyor so that said fluid flows axially through the filter plugs.

13. Apparatus as defined in claim 12, wherein said conveyor is a rotary drum having axially parallel flutes for transporting the filter plugs sideways.

14. Apparatus as defined in claim 12, wherein said measuring means comprises transducer means arranged to produce said signals in response to changes in pressure differential between the ends of filter plugs on said conveyor.

15. Apparatus as defined in claim 14, wherein said transducer means is arranged to produce signals in response to changes in pressure differential between the ends of several filter plugs on said conveyor.

16. Apparatus as defined in claim 11, wherein said means for conveying the fluid is arranged to establish a pressure differential between opposite sides of successive increments of the tow upstream of said wrapping means so that the fluid is conveyed transversely across such increments.

17. Apparatus as defined in claim 11, wherein said means for conveying the fluid comprises suction generating means and conduit means connected with said suction generating means to draw the fluid through the stretched tow, said measuring means comprising transducer means including a suction chamber connected with said conduit means, capacitor means including an electrode movable in said chamber as a function of pressure changes in said conduit means, and an electric circuit arranged to produce said signals as a function of the position of said electrode.

18. Apparatus as defined in claim 11, wherein said wrapping means comprises first conveyor means for advancing the stretched tow and the web at a constant speed, and further comprising second conveyor means for feeding the stretched tow to said first conveyor means at a variable speed, said control means including means for changing the speed of said second conveyor means.

19. Apparatus as defined in claim 11, wherein said wrapping means comprises first conveyor means for advancing the stretched tow and the web at a variable speed and further comprising second conveyor means for feeding the stretched tow to said first conveyor means at a constant speed, said control means comprising means for changing the speed of said first conveyor means.

* * * * *

UNITED STATES PATENT OFFICE

CERTIFICATE OF CORRECTION

Patent No. 3,971,695 Dated July 27, 1976

Inventor(s) Hans-Jürgen BLOCK

It is certified that error appears in the above-identified patent and that said Letters Patent are hereby corrected as shown below:

Front page, left-hand column, the following insertion should appear between the items [21] and [52]:

--[30] Foreign Application Priority Data
January 22, 1969 Germany 1902954--.

Col. 8, line 7, "difference" should read --differences--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*